US012747505B2

(12) United States Patent
Shoji et al.

(10) Patent No.: US 12,747,505 B2
(45) Date of Patent: Sep. 29, 2026

(54) SURFACE-TREATED METAL SHEET

(71) Applicant: NIPPON STEEL CORPORATION, Tokyo (JP)

(72) Inventors: Hiromasa Shoji, Tokyo (JP); Kohei Ueda, Tokyo (JP); Satoru Yonetani, Tokyo (JP); Tomokazu Sugitani, Tokyo (JP); Nobuki Shiragaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 489 days.

(21) Appl. No.: 18/036,316

(22) PCT Filed: Nov. 11, 2021

(86) PCT No.: PCT/JP2021/041535

§ 371 (c)(1),
(2) Date: May 10, 2023

(87) PCT Pub. No.: WO2022/102710

PCT Pub. Date: May 19, 2022

(65) Prior Publication Data

US 2023/0399750 A1 Dec. 14, 2023

(30) Foreign Application Priority Data

Nov. 13, 2020 (JP) ..... 2020-189316

(51) Int. Cl.
*C23C 22/36* (2006.01)
*C23C 30/00* (2006.01)

(52) U.S. Cl.
CPC ..... *C23C 22/361* (2013.01); *C23C 30/00* (2013.01)

(58) Field of Classification Search
CPC ... C23C 22/361; C23C 30/00; C23C 2222/20; C23C 28/3225; C23C 22/44;
(Continued)

(56) References Cited

U.S. PATENT DOCUMENTS 7,291,402 B2 11/2007 Kazuhisa et al.
11,965,249 B2 * 4/2024 Shoji ..... C23C 28/3225
(Continued)

FOREIGN PATENT DOCUMENTS

EP 3 070 186 A1 9/2016
JP 4709942 B2 6/2011
(Continued)

*Primary Examiner* — Danielle M. Carda
(74) *Attorney, Agent, or Firm* — Birch, Stewart, Kolasch & Birch, LLP

(57) ABSTRACT

A surface-treated metal sheet includes a steel sheet, a coating layer containing zinc formed on the steel sheet and a conversion coating formed on the coating layer, wherein the conversion coating contains an organosilicon compound, a phosphate compound and a fluorine compound, and when the surface roughness in a rectangular area with a side of 1 μm on the surface of the conversion coating is represented by an arithmetic mean height of the scale limited surface Sa, a maximum height of the scale limited surface Sz, and a root mean square height of the scale limited surface Sq, one or more conditions of an arithmetic mean height of the scale limited surface Sa being 0.1 to 10 nm, a maximum height of the scale limited surface Sz being 1 to 1,000 nm, and a root mean square height of the scale limited surface Sq being 0.1 to 100 nm are satisfied.

8 Claims, 2 Drawing Sheets

(58) Field of Classification Search
CPC ..... C23C 28/34; C23C 28/345; C23C 2/26; C23C 2/06; C23C 22/36; C23C 28/00; B32B 15/013; C22C 18/00; C22C 18/04; C21D 8/0278
USPC ..... 148/247
See application file for complete search history.

(56) References Cited

U.S. PATENT DOCUMENTS

| | | | | |
|---|---|---|---|---|
| 2009/0110921 | A1* | 4/2009 | Kaneto | C23C 22/44 428/447 |
| 2010/0003529 | A1* | 1/2010 | Kikuchi | C23C 22/44 428/450 |
| 2014/0050939 | A1* | 2/2014 | Morishita | C09D 7/63 428/626 |
| 2018/0187313 | A1* | 7/2018 | Shoji | C23C 22/82 |
| 2022/0145473 | A1 | 5/2022 | Shoji et al. | |

FOREIGN PATENT DOCUMENTS

| | | | | |
|---|---|---|---|---|
| JP | 4776458 | B2 | 9/2011 | |
| JP | 2011-225942 | A | 11/2011 | |
| JP | 2013-213281 | A | 10/2013 | |
| JP | 5335434 | B2 | 11/2013 | |
| JP | 5336002 | B2 | 11/2013 | |
| JP | 2014-156615 | A | 8/2014 | |
| JP | 2015-175003 | A | 10/2015 | |
| WO | WO-2020129473 | A1 * | 6/2020 | C23C 22/23 |
| WO | WO 2020/189769 | A1 | 9/2020 | |

* cited by examiner

SURFACE-TREATED METAL SHEET

TECHNICAL FIELD

The present invention relates to a surface-treated metal sheet.

Priority is claimed on Japanese Patent Application No. 2020-189316, filed Nov. 13, 2020, the content of which is incorporated herein by reference.

BACKGROUND ART

Conventionally, treating steel sheets having a coating layer containing zinc with a chromate such as a hexavalent chromate in order to prevent rust has been widely performed, and in order to impart further advanced corrosion resistance, fingerprint resistance, scratch resistance, lubricity and the like according to necessity, coating with an organic resin is performed, and furthermore, overcoating with various paints is then performed.

In recent years, against the background of increasing environmental problems, there has been a movement to avoid chromate treatments. Since a chromate treatment layer itself has advanced corrosion resistance and paint adhesion, it is expected that these aspects of performance will be significantly reduced if this chromate treatment is not performed. Therefore, it has become necessary to form a rust-preventive layer having favorable corrosion resistance and paint adhesion simply by one-step treatment with an organic resin without performing a base treatment based on a chromate treatment.

Patent Document 1 describes a surface metal treatment material having a composite coating containing respective components obtained by applying a surface-treated metal agent composed of an organosilicon compound, at least one fluoro compound selected from fluorotitanic acid and fluorozironic acid, phosphoric acid, and a vanadium compound to a surface of a metal material and drying it.

Patent Document 2 describes a surface metal treatment material having a composite coating containing an organosilicon compound, at least one fluoro compound selected from fluorotitanic acid and fluorozironic acid, phosphoric acid, a vanadium compound, and a lubricant which is at least one selected from the group consisting of an aqueous dispersion type polyethylene wax, polypropylene wax and polytetrafluoroethylene, and has a number average particle size of 0.01 μm to 1.0 μm and a softening temperature of 100° C. or higher on a surface of a metal material.

Patent Document 3 describes a chromate-free surface-treated metal material having a conversion coating formed by applying an aqueous treatment agent containing an organosilicon compound and an organic fluorine compound having a perfluoroalkyl group to the surface of a metal material, and drying or baking it.

Patent Document 4 describes a surface-treated metal material having a composite coating which contains an organosilicon compound as a film-forming component, at least one metal compound selected from the group consisting of titanium compounds and zirconium compounds, a phosphate compound and a fluorine compound as inhibitor components, and in which an abundance ratio of cyclic siloxane bonds and chain siloxane bonds in the organosilicon compound is 1.0 to 2.0 as a ratio W1/W2 of the absorbance W1 at 1,090 to 1,100 $cm^{-1}$ indicating a cyclic siloxane bond and the absorbance W2 at 1,030 to 1,040 $cm^{-1}$ indicating a chain siloxane bond according to an FT-IR reflection method on the surface of a metal material.

CITATION LIST

[Patent Document]

[Patent Document 1]

Japanese Patent No. 4776458

[Patent Document 2]

Japanese Patent No. 5335434

[Patent Document 3]

Japanese Patent No. 4709942

[Patent Document 4]

Japanese Patent No. 5336002

SUMMARY OF THE INVENTION

Problems to be Solved by the Invention

Incidentally, the lubricity performance of a plated steel sheet on which a conversion coating is formed by a chemical conversion treatment is determined by the conversion coating on the outermost surface. The lubricity is evaluated by factors such as a dynamic friction coefficient on the surface of the conversion coating. When a conventional chromate coating is replaced with a chromate-free coating, a substitute chromate-free coating is required to have a level of lubricity equivalent to that of the chromate coating. If the lubricity of the chromate-free coating is reduced, when a plurality of plated steel sheets are stacked flat, load collapse, which was not a problem with the chromate coating, is more likely to occur. In addition, if the lubricity of the chromate-free coating is different from the lubricity of the chromate coating, for example, when roll forming is performed on the plated steel sheet, it is necessary to readjust processing setting conditions. However, so far there have been no attempts to make the lubricity of a chromate-free coating closer to the lubricity of a chromate coating.

The present invention has been made in view of the above circumstances and an object of the present invention is to provide a surface-treated metal sheet having a conversion coating that has a level of lubricity equivalent to that of a conventional chromate coating and has excellent corrosion resistance and paint adhesion.

Means for Solving the Problem

The gist of the present invention, which has been made to address the above problems, is as follows.

[1] A surface-treated metal sheet according to one aspect of the present invention including:

a steel sheet;

a coating layer (plating layer) containing zinc formed on the steel sheet; and a conversion coating formed on the coating layer, wherein the conversion coating contains an organosilicon compound, a phosphate compound and a fluorine compound, wherein, when the surface roughness in a rectangular area with a side of 1 μm on the surface of the conversion coating is represented by an arithmetic mean height of the scale limited surface Sa, a maximum height of the scale limited surface Sz, and a root mean square height of the scale limited surface Sq, one or more of an arithmetic mean height of the scale limited surface Sa being 0.10 to 10.0 nm, a maximum height of the scale limited surface Sz being 1.0 to 1,000 nm, and a root mean square r height of the scale limited surface Sq being 0.10 to 100 nm are satisfied.

[2] In the surface-treated metal sheet according to [1], when the surface roughness in a rectangular area with a side of 5 μm on the surface of the conversion coating is represented by an arithmetic mean height of the scale limited surface Sa, a maximum height of the scale limited surface Sz, and a root mean square height of the scale limited surface Sq, one or more of an arithmetic mean height of the scale limited surface Sa being 0.10 to 10 nm, a maximum height of the scale limited surface S being 1.0 to 1,000 nm, and a root mean square height of the scale limited surface Sq being 0.10 to 100 nm may be satisfied.

[3] In the surface-treated metal sheet according to [1] or [2], the rectangular area with a side of 1 μm on the surface of the conversion coating may contain 1 or more and 100 or less granular organosilicon compound particles having a major axis of 10 nm or more and 300 nm or less.

[4] In the surface-treated metal sheet according to any one of [1] to [3], the coating layer may have an average chemical composition containing, in mass %,
Al: more than 4.0% and less than 25.0%,
Mg: more than 1.0% and less than 12.5%,
Sn: 0% to 20%,
Bi: 0% and less than 5.0%,
In: 0% and less than 2.0%,
Ca: 0% to 3.0%,
Y: 0% to 0.5%,
La: 0% and less than 0.5%,
Ce: 0% and less than 0.5%,
Si: 0% and less than 2.5%,
Cr: 0% and less than 0.25%,
Ti: 0% and less than 0.25%,
Ni: 0% and less than 0.25%,
Co: 0% and less than 0.25%,
V: 0% and less than 0.25%,
Nb: 0% and less than 0.25%,
Cu: 0% and less than 0.25%,
Mn: 0% and less than 0.25%,
Fe: 0% to 5.0%,
Sr: 0% and less than 0.5%,
Sb: 0% and less than 0.5%,
Pb: 0% and less than 0.5%, and
B: 0% and less than 0.5% with the remainder being Zn and impurities.

Effects of the Invention

According to the above aspects of the present invention, it is possible to provide a surface-treated metal sheet having a conversion coating that has a level of lubricity equivalent to that of a conventional chromate coating and has excellent corrosion resistance and paint adhesion.

EMBODIMENT(S) FOR IMPLEMENTING THE INVENTION

Figure 1:
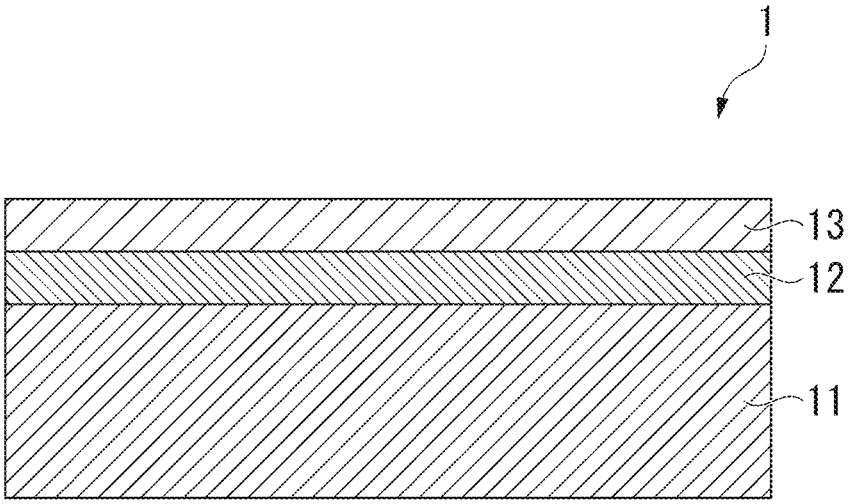
FIG. 1 is a schematic cross-sectional view of a surface-treated metal sheet according to the present embodiment.

In order to realize a conversion coating that has a level of lubricity equivalent to that of a conventional chromate coating and also has paint adhesion and corrosion resistance, the inventors conceived a conversion coating design for controlling the roughness of a microscopic area on the surface of a conversion coating. Generally, the roughness is measured in an area of "mm (millimeters)" or "cm (centimeters)" as a measurement area by a roughness meter or the like. However, the inventors postulated that the roughness in a micrometer area actually controls the lubricity (dynamic friction coefficient) and paint adhesion, and designed the following chromate-free coating.

That is, it was found that, in order to improve the paint adhesion and control the lubricity (dynamic friction coefficient) according to a physical action, when the surface roughness in a rectangular (including a square) area with a side length of 1 μm is represented by an arithmetic mean height of the scale limited surface Sa, a maximum height of the scale limited surface Sz, and a root mean square height of the scale limited surface Sq, and one or more conditions among an arithmetic mean height of the scale limited surface Sa being 0.10 to 10.0 nm, a maximum height of the scale limited surface Sz being 1.0 to 1,000 nm, and a root mean square height of the scale limited surface Sq being 0.10 to 100 nm are satisfied, the lubricity (dynamic friction coefficient) can be made to be equivalent to that of the chromate coating.

In addition, it was found that, in a rectangular area with a side length of 5 μm, when one or more of an arithmetic mean height of the scale limited surface Sa being 0.10 to 10.0 nm, a maximum height of the scale limited surface Sz being 1.0 to 1,000 nm, and a root mean square height of the scale limited surface Sq being 0.10 to 100 nm are satisfied, the lubricity can be better controlled.

In addition, it can be understood that, in order to improve the paint adhesion according to a chemical action, when the main component of the conversion coating is an organosilicon compound, the lubricity (dynamic friction coefficient) can be made to be equivalent to that of the chromate coating, and the paint adhesion is improved.

In addition, it is found that it is effective to incorporate a phosphate compound and a fluorine compound into a conversion coating as components that improve corrosion resistance without influencing lubricity and paint adhesion.

It can be understood that, in order to realize the above design concept, immediately after a surface-treated metal agent with a viscosity of 0.5 mPa·s to 2.0 mPa·s is applied, when natural drying (first drying process) is performed in an atmosphere of 10 to 35° C. and a relative humidity of 30 to 90% for 0.2 to 10 seconds, and additional heat drying (second drying process) is then performed, the roughness of the microscopic area on the surface of the conversion coating can be controlled to be to be within the above range.

Hereinafter, a surface-treated metal sheet which is one embodiment of the present invention will be described.

The surface-treated metal sheet of the present embodiment includes a steel sheet, a coating layer containing zinc formed on the steel sheet, and a conversion coating formed on the coating layer, the conversion coating contains an organosilicon compound, a phosphate compound and a fluorine compound, and when the surface roughness in a rectangular area with a side of 1 μm on the surface of the conversion coating is represented by an arithmetic mean height of the scale limited surface Sa, a maximum height of the scale limited surface Sz, and a root mean square height of the scale limited surface Sq, one or more conditions of an arithmetic mean height of the scale limited surface Sa being 0.10 to 10 nm, a maximum height of the scale limited surface Sz being 1.0 to 1,000 nm, and a root mean square height of the scale limited surface Sq being 0.10 to 100 nm are satisfied.

In addition, when the surface roughness in a rectangular area with a side of 5 μm on the surface of the conversion coating is represented by an arithmetic mean height of the scale limited surface Sa, a maximum height of the scale limited surface Sz, and a root mean square height of the scale limited surface Sq, it is preferable that one or more of an arithmetic mean height of the scale limited surface Sa being 0.10 to 10.0 nm, a maximum height of the scale limited surface Sz being 1.0 to 1,000 nm, and a root mean square height of the scale limited surface Sq being 0.10 to 100 nm be satisfied.

In addition, the rectangular area with a side of 1 μm on the surface of the conversion coating preferably contains 1 or more and 100 or less granular organosilicon compound particles having a major axis of 10 nm or more and 300 nm or less.

In the following description, "%" of the amount of each element in the chemical composition means "mass %." In addition, when a numerical value range is indicated using "to," the range includes numerical values stated before and after "to" as a lower limit value and an upper limit value. Here, a numerical value range when "more than" or "less than" is attached to numerical values stated before and after "to" means a range that does not include these numerical values as a lower limit value or an upper limit value.

<Steel Sheet 11>

As shown in FIG. 1, a surface-treated metal sheet 1 according to the present embodiment can obtain the same level of lubricity as when a chromate coating is formed by a coating layer 12 and a composite coating 13. In addition, the surface-treated metal sheet 1 according to the present embodiment has excellent corrosion resistance and paint adhesion of the conversion coating. Therefore, a steel sheet 11 is not particularly limited, and it may be determined according to application products, the required strength, the sheet thickness and the like. For the material of the steel sheet 11, for example, various steel sheets such as general steel, Ni pre-plated steel, Al killed steel, ultra-low carbon steel, high carbon steel, various high-tensile steels, and some high-alloy steels (steel containing strengthening elements such as Ni and Cr, etc.) can be applied. In addition, conditions such as a production method (a hot rolling method, a pickling method, a cold rolling method, etc.) of the steel sheet 11 are not particularly limited. In addition, as the steel sheet 11, a steel sheet on which a film of a metal or alloy such as Zn, Ni, Sn, or an alloy thereof having a thickness of less than 1 μm is formed may be used. Examples of the steel sheet 11 include hot-rolled steel sheets described in HS G 3193:2008 and cold-rolled steel sheets described in JIS G 3141:2017.

<Coating Layer 12>

The coating layer 12 provided on the surface-treated metal sheet 1 according to the present embodiment is formed on the surface of the steel sheet 11 and contains zinc. The amount of zinc may be, for example, 50 mass % or more. In addition, the coating layer 12 may contain aluminum. In addition, it may further contain magnesium. The corrosion resistance of the coating layer 12 improves in the order of a coating layer containing zinc, a coating layer containing zinc and aluminum, and a coating layer containing zinc, aluminum and magnesium. The surface-treated metal sheet 1 according to the present embodiment may have any coating layer among these coating layers. When aluminum is contained, the amount thereof is less than 25.0 mass %, and when magnesium is contained, the amount thereof is less than 12.5 mass %.

As the coating layer 12 containing zinc, for example, a coating layer of hot-dip galvanized steel or electrogalvanized layer composed of zinc and the remainder being impurities may be exemplified. In addition, as the coating layer 12 containing zinc and aluminum, for example, a hot-dip coating layer composed of zinc, aluminum and the remainder being impurities, and a hot-dip coating layer containing additional additive elements may be exemplified. In addition, as the coating layer 12 containing zinc, aluminum and magnesium, for example, a hot-dip coating layer composed of zinc, aluminum, magnesium and the remainder being impurities and a hot-dip coating layer containing additional additive elements may be exemplified.

Hereinafter, a chemical composition of the coating layer 12 containing zinc, aluminum, and magnesium will be described.

The coating layer 12 preferably has a chemical composition including Al: more than 4.0% and less than 25.0%, Mg: more than 1.0% and less than 12.5%, Sn: 0% to 20%, Bi: 0% and less than 5.0%, In: 0% and less than 2.0%, Ca: 0% to 3.0%, Y: 0% to 0.5%, La: 0% and less than 0.5%, Ce: 0% and less than 0.5%, Si: 0% and less than 2.5%, Cr: 0% and less than 0.25%, Ti: 0% and less than 0.25%, Ni: 0% and less than 0.25%, Co: 0% and less than 0.25%, V: 0% and less than 0.25%, Nb: 0% and less than 0.25%, Cu: 0% and less than 0.25%, Mn: 0% and less than 0.25%, Fe: 0% to 5.0%, Sr: 0% and less than 0.5%, Sb: 0% and less than 0.5%, Pb: 0% and less than 0.5%, B: 0% and less than 0.5% with the remainder being Zn and impurities.

[Al: More than 4.0% and Less than 25.0%]

Al is an element effective for securing corrosion resistance in the coating layer 12 containing aluminum (Al), zinc (Zn), and magnesium (Mg). In order to sufficiently obtain the above effect, the Al content is preferably more than 4.0%.

On the other hand, if the Al content is 25.0% or more, corrosion resistance of the cut end surface of the coating layer 12 decreases. Therefore, the Al content is preferably less than 25.0%.

[Mg: More than 1.0% and Less than 12.5%]

Mg is an element having an effect of improving corrosion resistance of the coating layer 12. In order to sufficiently obtain the above effect, the Mg content is preferably more than 1.0%.

On the other hand, if the Mg content is 12.5% or more, the effect of improving corrosion resistance is maximized and the processability of the coating layer 12 deteriorates. In addition, if the Mg content is 12.5% or more, production problems occur such as an increase in the amount of dross generated in a coating bath. Therefore, the Mg content is preferably less than 12.5%.

The coating layer 12 may contain Al and Mg, with the remainder being Zn and impurities. However, as necessary, it may further contain the following elements.

[Sn: 0% to 20%]

[Bi: 0% and Less than 5.0%]

[In: 0% and Less than 2.0%]

When the coating layer 12 contains these elements, new intermetallic compound phases such as a $Mg_2Sn$ phase, a $Mg_3Bi_2$ phase, and a $Mg_3In$ phase are formed in the coating layer 12.

These elements form an intermetallic compound phase only with Mg without forming an intermetallic compound phase with either Zn or Al that constitutes the main body of the coating layer 12. When a new intermetallic compound phase is formed, the weldability of the coating layer 12 changes greatly. Since any intermetallic compound phase has a high melting point, it exists as an intermetallic compound phase without evaporating after welding. Mg, which inherently tends to form MgO through oxidization from welding heat, does not oxidize because of the formation of an intermetallic compound phase with Sn, Bi, and In, and it becomes easy to remain without change as the intermetallic compound phase in the coating layer 12 even after welding. Therefore, when these elements are present in the coating layer 12, corrosion resistance and sacrificial corrosion resistance are improved, and corrosion resistance around the welded part is improved. In order to obtain the above effects, the amount of each element is preferably 0.05% or more.

Among these elements, Sn is preferable because it is a low-melting-point metal and can be easily contained without impairing the properties of a coating bath. The upper limit of these elements may be 20% or less for Sn, less than 5.0% for Bi, and less than 2.0% for In.

[Ca: 0% to 3.0%]

When the coating layer 12 contains Ca, the amount of dross formed, which tends to be formed during a coating operation, is reduced as the Mg content increases, and the productivity of coating is improved. Therefore, Ca may be contained. In order to obtain the effects, the Ca content is preferably 0.1% or more.

On the other hand, if the Ca content is large, the corrosion resistance of the flat part of the coating layer 12 itself tends to deteriorate, and the corrosion resistance around the welded part may also deteriorate. Therefore, even if Ca is contained, the Ca content is preferably 3.0% or less.

[Y: 0% to 0.5%]

[La: 0% and Less than 0.5%]

[Ce: 0% and Less than 0.5%]

Y, La, and Ce are elements that contribute to improving corrosion resistance. In order to obtain this effect, it is preferable to contain 0.05% or more of one or more of Y, La, and Ce.

On the other hand, if the amount of these elements becomes excessive, the viscosity of the coating bath increases, it is often difficult to make the coating bath itself, and the surface-treated metal sheet 11 having favorable plating properties cannot be produced. Therefore, even if they are contained, it is preferable that the Y content be 0.5% or less, the La content be less than 0.5%, and the Ce content be less than 0.5%.

[Si: 0% and Less than 2.5%]

Si is an element that forms a compound together with Mg and contributes to improving corrosion resistance. In addition, Si is an element that, when the coating layer 12 is formed on the steel sheet 11, prevents the alloy layer formed between the surface of the steel sheet 11 and the coating layer 12 from being formed excessively thickly, and has an effect of increasing the adhesion between the steel sheet 11 and the coating layer 12. In order to obtain these effects, the Si content is preferably 0.1% or more and more preferably 0.2% or more.

On the other hand, if the Si content is 2.5% or more, excessive Si precipitates in the coating layer 12, and as a result, not only the corrosion resistance deteriorates, but also the processability of the coating layer 12 deteriorates. Therefore, the Si content is preferably less than 2.5% and more preferably 1.5% or less.

[Cr: 0% and Less than 0.25%]

[Ti: 0% and Less than 0.25%]

[Ni: 0% and Less than 0.25%]

[Co: 0% and Less than 0.25%]

[V: 0% and Less than 0.25%]

[Nb: 0% and Less than 0.25%]

[Cu: 0% and Less than 0.25%]

[Mn: 0% and Less than 0.25%]

Cr, Ti, Ni, Co, V, Nb, Cu and Mn are elements that contribute to improving corrosion resistance. In order to obtain this effect, the amount of each element is preferably 0.05% or more.

On the other hand, if the amount of these elements becomes excessive, the viscosity of the coating bath increases, it is often difficult to make the coating bath itself, and the surface-treated metal sheet 1 having favorable plating properties cannot be produced. Therefore, the amount of each element is preferably less than 0.25%.

[Fe: 0% to 5.0%]

Fe is an element that is inevitably mixed into the coating layer 12 as impurities when the coating layer 12 is produced. The amount of Fe is about 5.0%, but within this range, the adverse influence on the effect of the surface metal treatment sheet 11 according to the present embodiment is small. On the other hand, if the Fe content is more than 5.0%, there is a risk of corrosion resistance of the coating layer 12 deteriorating. Therefore, the Fe content is preferably 5.0% or less.

[Sr: 0% and Less than 0.5%]

[Sb: 0% and Less than 0.5%]

[Pb: 0% and Less than 0.5%]

When the coating layer 12 contains Sr, Sb, and Pb, the appearance of the coating layer 12 changes, spangles are formed, and an improvement in metallic luster is confirmed. In order to obtain this effect, the amount of each of Sr, Sb, and Pb is preferably 0.05% or more.

On the other hand, if the amount of these elements becomes excessive, the viscosity of the coating bath increases, it is often difficult to make the coating bath itself, and the surface-treated metal sheet 1 having favorable plating properties cannot be produced. Therefore, it is preferable that the Sr content be less than 0.5%, the Sb content be less than 0.5%, and the Pb content be less than 0.5%.

[B: 0% and Less than 0.5%]

B is an element that, when contained in the coating layer 12, combines with Zn, Al, and Mg to form various intermetallic compound phases. This intermetallic compound has an effect of improving liquid metal embrittlement (LME). In order to obtain this effect, the B content is preferably 0.05% or more.

On the other hand, if the B content becomes excessive, the melting point of the coating bath significantly rises, the plating operability deteriorates, and the surface-treated metal sheet 1 having favorable plating properties cannot be obtained. Therefore, the B content is preferably less than 0.5%.

The adhesion amount of the coating layer 12 is not limited, and it is preferably 10 $g/m^2$ or more in order to improve corrosion resistance. On the other hand, even if the adhesion amount exceeds 200 $g/m^2$, the corrosion resistance is maximized, and it is economically disadvantageous. Therefore, the adhesion amount is preferably 200 $g/m^2$ or less.

<Conversion Coating 13>

The conversion coating 13 provided on the surface of the coating layer 12 of the surface-treated metal sheet 1 according to the present embodiment contains an organosilicon compound, a phosphate compound and a fluorine compound. The conversion coating 13 may further contain a zirconium compound and may contain a vanadium compound. In addition, the conversion coating 13 according to the present embodiment does not contain a Cr compound and is a so-called chromate-free coating. When the conversion coating 13 contains an organosilicon compound, a phosphate compound and a fluorine compound, corrosion resistance and paint adhesion can be imparted to the surface-treated metal sheet 1.

In the present embodiment, the organosilicon compound contained in the conversion coating 13 is not limited, and for example, those obtained by mixing a silane coupling agent (A) containing one amino group in the molecule and a silane coupling agent (B) containing one glycidyl group in the molecule at a ratio of 0.5 to 2.0 and preferably 0.5 to 1.7 in terms of a solid content mass ratio [(A)/(B)] may be used.

The mixing ratio of the silane coupling agent (A) and the silane coupling agent (B) in terms of the solid content mass ratio [(A)/(B)] is 0.5 to 2.0, and preferably 0.5 to 1.7. If the solid content mass ratio [(A)/(B)] is less than 0.5, the fingerprint resistance, bath stability, and black deposit resistance may significantly deteriorate. On the other hand, if the solid content mass ratio [(A)/(B)] exceeds 2.0, this is not preferable because the water resistance significantly decreases in some cases. [(A)/(B)] is more preferably 0.7 to 1.7 and still more preferably 0.9 to 1.1.

The silane coupling agent (A) containing one amino group is not particularly limited, and examples thereof include 3-aminopropyltriethoxysilane and 3-aminopropyltrimethoxysilane. As the silane coupling agent (B) containing one glycidyl group in the molecule, 3-glycidoxypropyltrimethoxysilane and 3-glycidoxypropyltriethoxysilane is an exemplary example.

In the present embodiment, the phosphate compound contained in the conversion coating 13 is not particularly limited, and examples thereof include phosphoric acid, phosphate ammonium salts, potassium phosphate, and sodium phosphate salts. Among these, phosphoric acid is more preferable. When phosphoric acid is used, it is possible to obtain better corrosion resistance.

Regarding the amount of the phosphate compound in the conversion coating 13, when the average value of P/Si, which is a ratio of the solid content mass of P derived from a phosphate compound and the solid content mass of Si derived from an organosilicon compound, is 0.15 to 0.25, this is preferable because the homogeneity of the conversion coating 13 is maintained. When the average value of P/Si is 0.15 or more, there is no risk of corrosion resistance deteriorating due to P deficiency. In addition, when the average value of P/Si is 0.25 or less, it is possible to prevent the conversion coating 13 from becoming water soluble.

In the present embodiment, the fluorine compound contained in the conversion coating 13 is not particularly limited, and examples thereof include fluorides such as hydrofluoric acid, hydroborofluoric acid, hydrofluoric silicic acid, and water-soluble salts thereof and complex fluoride salts. Among these, hydrofluoric acid is more preferable. When hydrofluoric acid is used, it is possible to obtain better corrosion resistance and coatability.

In the conversion coating 13, when the average value of F/Si, which is a ratio of the solid content mass of F derived from a fluorine compound and the solid content mass of Si derived from an organosilicon compound is 0.01 to 0.15, this is preferable because it can secure appropriate corrosion resistance while the homogeneity of the conversion coating 13 is maintained.

The conversion coating 13 may contain a zirconium compound. The zirconium compound is not particularly limited, and examples thereof include zircon hydrofluoric acid, ammonium hexafluorozirconate, zirconium sulfate, zirconium oxychloride, zirconium nitrate, and zirconium acetate. Among these, zircon hydrofluoric acid is more preferable. When zirconium hydrofluoric acid is used, it is possible to obtain better corrosion resistance and coatability. In addition, zirconium hydrofluoric acid is preferable because it also acts as a fluorine compound.

In addition, the conversion coating 13 may contain a vanadium compound. The vanadium compound (V) is not particularly limited, and examples thereof include vanadium pentoxide $V_2O_5$, metavanadate $HVO_3$, ammonium metavanadate, sodium metavanadate, vanadium oxytrichloride $VOCl_3$, vanadium trioxide $V_2O_3$, vanadium dioxide $VO_2$, vanadium oxysulfate $VOSO_4$, vanadium oxyacetylacetonate $VO(OC(=CH_2)CH_2COCH_3)_2$, vanadium acetylacetonate $V(OC(=CH_2)CH_2COCH_3)_3$, vanadium trichloride $VCl_3$, and phosphovanadomolybdic acid. In addition, those obtained by reducing a pentavalent vanadium compound to a vanadium compound with a valency of 4 to 2 with an organic compound having at least one functional group selected from the group consisting of a hydroxyl group, a carbonyl group, a carboxyl group, a primary to tertiary amino group, an amide group, a phosphate group and a phosphonic acid group can be used.

In the conversion coating 13, when the average value of Zr/Si, which is a ratio of the solid content mass of Zr derived from a zirconium compound and the solid content mass of Si derived from an organosilicon compound, is 0.06 to 0.15, this is preferable because the homogeneity of the conversion coating 13 is maintained. When the average value of Zr/Si is 0.06 or more, the barrier property is sufficient, and there is no risk of corrosion resistance deteriorating. In addition, when the average value of Zr/Si is 0.15 or less, this is preferable because sufficient corrosion resistance is secured.

In addition, in the conversion coating 13, when the average value of V/Si, which is a ratio of the solid content mass of V derived from a vanadium compound and the solid content mass of Si derived from an organosilicon compound, is 0.010 to 0.200, this is preferable because the V compound is appropriately precipitated in an area with low corrosion resistance while the homogeneity of the conversion coating 13 is maintained. When the average value of V/Si is 0.010 or more, there is no risk of corrosion resistance deteriorating because V, which is a corrosion inhibitor, is sufficient. In addition, when the average value of V/Si is 0.200 or less, there is no risk of the conversion coating becoming water-soluble.

F/Si, P/Si, Zr/Si, and V/Si can be measured using micro fluorescent X-rays.

Specifically, F/Si, P/Si, Zr/Si, and V/Si can be measured using micro fluorescent X-rays (energy-dispersive micro fluorescent X-ray spectrometer Orbis, a tube voltage: 5 kV, a tube current: 1 mA, commercially available from AMETEK, Inc.) using an X-ray source with Rh and a spot size of φ30 μm. During measurement, for the surface of the conversion coating 13, in an area of about 2.3 mm in the horizontal direction×about 1.5 mm in the vertical direction, with 256×200 pixels, mass percentages of F, P, Zr, V and Si in detectable elements that constitute the conversion coating 13 are measured, and F/Si, P/Si, Zr/Si, and V/Si are calculated from the results.

The adhesion amount per one surface of the conversion coating 13 is preferably 0.05 to 2.0 $g/m^2$, more preferably 0.2 to 1.0 $g/m^2$, and most preferably 0.3 to 0.6 $g/m^2$. If the adhesion amount per one surface of the conversion coating 13 is less than 0.05 $g/m^2$, this is not preferable because the surface of the coating layer 12 cannot be sufficiently coated, and as a result, the corrosion resistance significantly decreases. If the adhesion amount exceeds 2.0 g/m$^2$, since the effect of improving corrosion resistance is maximized, the upper limit may be 2.0 g/m$^2$ or less.

Next, the surface roughness of the conversion coating 13 of the present embodiment will be described.

When the surface roughness in a rectangular area with a side of 1 μm on the surface of the conversion coating 13 of the present embodiment is represented by an arithmetic mean height of the scale limited surface Sa, a maximum height of the scale limited surface Sz, and a root mean square height of the scale limited surface Sq, at least one condition of an arithmetic mean height of the scale limited surface Sa being 0.10 to 10.0 nm, a maximum height of the scale limited surface Sz being 1.0 to 1,000 nm and a root mean square height of the scale limited surface Sq being 0.10 to 100 nm is satisfied.

In addition, when the surface roughness in a rectangular area with a side of 5 μm on the surface of the conversion coating 13 of the present embodiment is represented by an arithmetic mean height of the scale limited surface Sa, a maximum height of the scale limited surface Sz, and a root mean square height of the scale limited surface Sq, it is preferable that at least one of an arithmetic mean height of the scale limited surface Sa being 0.10 to 10.0 nm, a maximum height of the scale limited surface Sz being 1.0 to 1,000 nm and a root mean square height of the scale limited surface Sq being 0.10 to 100 nm be satisfied.

Hereinafter, the reasons for limiting the surface roughness will be described.

<Surface Roughness in Rectangular Area with Side of 1 μm>

The inventors found that, in order to make the lubricity of the conversion coating 13 of the present embodiment closer to the lubricity of the chromate coating, it is necessary to evaluate the surface roughness of the conversion coating itself in a state in which the influence of the surface roughness of the coating layer 12 is removed, that is, in a micron area (microscopic area). In order to obtain the conversion coating 13 having a level of lubricity equivalent to that of a conventional chromate coating, first, it is necessary to accurately evaluate the lubricity of the coating 13 itself. However, since the conversion coating 13 is formed on the coating layer 12, the surface roughness of the conversion coating 13 is influenced by the surface roughness of the coating layer 12. In addition, when the surface roughness is measured in units of millimeters or centimeters as the measurement length, since it is influenced by the relatively large unevenness derived from the surface state of the coating layer 12, it is difficult to correctly evaluate the lubricity of the conversion coating 13 itself. Therefore, the inventors investigated and found that, when the measurement area for surface roughness is set to a microscopic area in a micron unit, the influence of the surface roughness of the coating layer 12 is reduced, and the surface roughness of the conversion coating itself can be evaluated. Specifically, the measurement area for surface roughness is a rectangular (including a square) area with a side of 1 μm. Then, it is found that, in the microscopic area, when the surface roughness is precisely controlled to be within a predetermined range to be described below, it is possible to obtain the conversion coating 13 having a level of lubricity equivalent to that of a conventional chromate coating.

In addition, the conversion coating 13 has surface roughness corresponding to the surface roughness of the coating layer 12. The surface roughness of the coating layer 12 is relatively large, and when the surface roughness of the conversion coating 13, which reflects the surface roughness of the coating layer 12, is measured on a scale (unit) from millimeters to centimeters as a measurement length, the roughness is several μm to several tens of μm. Therefore, when another object comes into contact with the conversion coating 13, if the contact area between the conversion coating 13 and the object is microscopically observed, the object is a collection of a large number of point contact areas. Then, the inventors have found that it is preferable to evaluate the surface roughness in an area having a size corresponding to the point contact area in order to evaluate lubricity of the surface of the coating 13. Then, the inventors found that, regarding the measurement area for surface roughness, the lubricity of the coating 13 can be appropriately evaluated using a rectangular area with a side of 1 μm as the measurement area.

<Arithmetic Mean Height of the Scale Limited Surface Sa: 0.10 to 10.0 nm>

<Maximum Height of the Scale Limited Surface Sz: 1.0 to 1,000 nm>

<Root Mean Square Height of the Scale Limited Surface Sq: 0.10 to 100 nm>

As parameters for evaluating the surface roughness in a rectangular area with a side of 1 μm in the conversion coating 13 of the present embodiment, an arithmetic mean height of the scale limited surface Sa, a maximum height of the scale limited surface Sz, and a root mean square height of the scale limited surface Sq are used, and at least one of these conditions needs to be within a predetermined range. In order to make the lubricity of the conversion coating 13 closer to the lubricity of the chromate coating, the arithmetic mean height of the scale limited surface Sa is set to be within a range of 0.10 to 10 nm, the maximum height of the scale limited surface Sz is set to be within a range of 1.0 to 1,000 nm, and the root mean square height of the scale limited surface Sq is set to be within a range of 0.10 to 100 nm. In order to make the lubricity of the conversion coating 13 equivalent to the lubricity of the chromate coating, any one of Sa, Sz and Sq should satisfy the above conditions. In order to more stably control the lubricity of the conversion coating 13, that is, in order to make the lubricity of the conversion coating 13 closer to the lubricity of the chromate coating, it is preferable that all of Sa, Sz and Sq satisfy the above ranges.

<Surface Roughness in Rectangular Area with Side of 5 μm>

In order to further reduce the influence on the surface roughness of the coating layer 12 and to more accurately evaluate the surface roughness of the conversion coating 13 itself, it is also preferable to determine the surface roughness in a rectangular area with a side of 5 μm. Specifically, it is preferable that the conversion coating 13 also satisfy the following requirement for surface roughness in a rectangular area with a side of 5 μm. The evaluation result of the surface roughness in a rectangular area with a side of 5 μm is more easily influenced by the surface state of the coating layer 12 than the evaluation result for a rectangular area with a side of 1 μm. That is, it can be said that evaluation of the surface roughness in a rectangular area with a side of 5 μm is stricter than evaluation in a rectangular area with a side of 1 μm. Therefore, in the present embodiment, when the surface roughness in a rectangular area with a side of 5 μm satisfies the following requirement, it is possible to more stably obtain the conversion coating 13 having a level of lubricity equivalent to that of a conventional chromate coating.

<Arithmetic Mean Height of the Scale Limited Surface Sa: 0.10 to 10.0 nm>

<Maximum Height of the Scale Limited Surface Sz: 1.0 to 1,000 nm>

<Root Mean Square Height of the Scale Limited Surface Sq: 0.10 to 100 nm>

As parameters for evaluating the surface roughness in a rectangular area with a side of 5 μm of the conversion coating 13 of the present embodiment, as in the case of a 1 μm square area, an arithmetic mean height of the scale limited surface Sa, a maximum height of the scale limited surface Sz, and a root mean square height of the scale limited surface Sq are used, and at least one of these conditions needs to be within a predetermined range. In order to make the lubricity of the conversion coating 13 closer to the lubricity of the chromate coating, the arithmetic mean height of the scale limited surface Sa is set to be within a range of 0.10 to 10.0 nm, the maximum height of the scale limited surface Sz is set to be within a range of 1.0 to 1,000 nm, and the root mean square height of the scale limited surface Sq is set to be within a range of 0.10 to 100 nm. In addition, as in the case of defining the conversion coating 13 in a rectangular area with a side of 1 μm, in order to more stably control the lubricity of the conversion coating 13, that is, in order to make the lubricity of the conversion coating 13 closer to the lubricity of the chromate coating, it is preferable that all Sa, Sz and Sq in a rectangular area with a side of 5 μm of the conversion coating 13 satisfy the above ranges.

Next, the form and number density of organosilicon compounds in the conversion coating 13 will be described.

It is preferable that a rectangular area with a side of 1 μm on the surface of the conversion coating 13 of the present embodiment contain a range of 1 or more and 100 or less granular organosilicon compound particles having a major axis of 10 nm or more and 300 nm or less. Thereby, the lubricity is improved when an oil is applied to the surface of the conversion coating 13, and subsequent processing becomes easier. This is speculated to be because protrusions are formed on the surface of the conversion coating 13 with the granular organosilicon compound, and areas that effectively retain a lubricating oil are formed in voids formed between protrusions according to the formation of protrusions. However, if the major axis of the organosilicon compound particles is 100 nm or more and 300 nm or less, if 100 or more organosilicon compounds are present in the rectangular area with a side of 1 μm, it is not possible to secure the area that retains a lubricating oil. In addition, if the major axis is 10 nm or more and less than 100 nm, in order to secure the area that retains a lubricating oil, it is necessary to secure an area that is well-balanced with the major axis, but if there are more than 100 organosilicon compounds in the rectangular area with a side of 1 μm, it is not possible to secure that area. Therefore, the number of granular organosilicon compound particles having a major axis of 10 nm or more and 300 nm or less in the rectangular area with a side of 1 μm is preferably 100 or less. In addition, in order to secure the area for retaining such a lubricating oil, protrusions having a certain height or more are required. That is, if the size of the organosilicon compound that contributes to formation of protrusions is too small, since it is not possible to sufficiently retain a lubricating oil, organosilicon compound particles having a major axis of less than 10 nm are not subjected to measurement. On the other hand, if the size of the organosilicon compound that contributes to formation of protrusions is too large, since there is a risk of adversely influencing the lubricity of the conversion coating, the upper limit of the major axis of the organosilicon compound particles to be measured in the present embodiment is 300 nm or less. Here, the protrusion derived from the organosilicon compound described above influences the surface roughness. Therefore, in order to more appropriately control Sa, Sz and Sq, it is preferable to control the number density of organosilicon compound particles having a major axis of 10 nm or more and 300 nm or less to be within the above range.

<Evaluation Method>

Hereinafter, an evaluation method will be described.

A method of measuring Sa, Sz and Sq in a rectangular area with a side of 5 μm is as follows.

On the surface of the conversion coating 13, 20 areas are set as 5 μm square measurement areas. The setting areas are arbitrary. Then, based on the ISO 25178 standard, in the measurement areas, Sa, Sz and Sq are measured. A scanning probe microscope (AFM5500M commercially available from Hitachi High-Tech Science Corporation) is used as a measurement device, and the measurement mode is a dynamic focus microscope mode. SI-DF20 is used as the probe, and the tip radius is 10 nm. Then, the average values of the measurement results for 20 measurement areas are defined as Sa, Sz and Sq in a rectangular area with a side of 5 μm on the surface of the conversion coating.

Next, a method of measuring Sa, Sz and Sq in a rectangular area with a side of 1 μm is as follows.

On the surface of the conversion coating 13, 40 areas are set as 1 μm square measurement areas. Among the 40 measurement areas, 20 measurement areas are set within the above 20 5 μm rectangular measurement areas, and the remaining 20 measurement areas are arbitrarily set from positions different from the 5 μm rectangular areas. Then, based on the ISO 25178 standard, in the measurement areas, Sa, Sz and Sq are measured. The measurement device, measurement mode, probe and tip radius are as described above. Then, the average values of the measurement results for 40 measurement areas are defined as Sa, Sz and Sq in a rectangular area with a side of 1 μm on the surface of the conversion coating.

Next, the number density of organosilicon compounds will be described.

The measurement area set in the method of measuring Sa, Sz and Sq in a rectangular area with a side of 1 μm is used to measure the number density of organosilicon compounds. In a plurality of these measurement areas, images are measured in the measurement mode of a dynamic focus microscope. The organosilicon compounds in the image are determined, and the number of determined organosilicon compounds, and the size thereof are measured. In the plurality of measurement areas, that is, the above 40 measurement areas, the number of organosilicon compound particles and the major axis are measured, and the average values of the measurement results are used as the number of organosilicon compound particles in a rectangular area with a side of 1 μm on the surface of the conversion coating and the major axis thereof.

As a device for determining the organosilicon compound in the image under a dynamic focus microscope, an electron beam microanalyzer (EPMA) and a Fourier transform type microscopic infrared spectrophotometer (microscopic FT-IR) are used. Microscopic FT-IR measurement is performed in a reflection measurement mode. Si is detected by the EPMA, the periphery of the detected Si is measured by the microscopic FT-IR, and when an infrared spectrum corresponding to an organic portion of the organosilicon compound is obtained, the area from which the infrared absorption spectrum is obtained is determined as the organosilicon compound.

According to the surface-treated metal sheet of the present embodiment, it has a level of lubricity equivalent to that of a conventional chromate coating. In addition, according to the surface metal sheet of the present embodiment, it is possible to improve corrosion resistance and paint adhesion. Here, the lubricity can be evaluated by a dynamic friction coefficient. The conversion coating 13 according to the present embodiment has a dynamic friction coefficient of 0.2 to 0.5, which is equivalent to that of the chromate coating. In addition, regarding corrosion resistance, in evaluation of corrosion resistance according to a salt spray test, the rate of occurrence of white rust is less than 5% after 72 hours, and excellent corrosion resistance is exhibited. In addition, regarding secondary adhesion after coating (a grid peeling test 30 minutes after immersion in boiling water is performed after white paint coating), in a peeling test using one hundred 1 mm square grids (grid peeling test), the number of peeled pieces of the coating film is 20 or less, and excellent secondary adhesion is exhibited.

<Method of Forming Conversion Coating>

Figure 2:
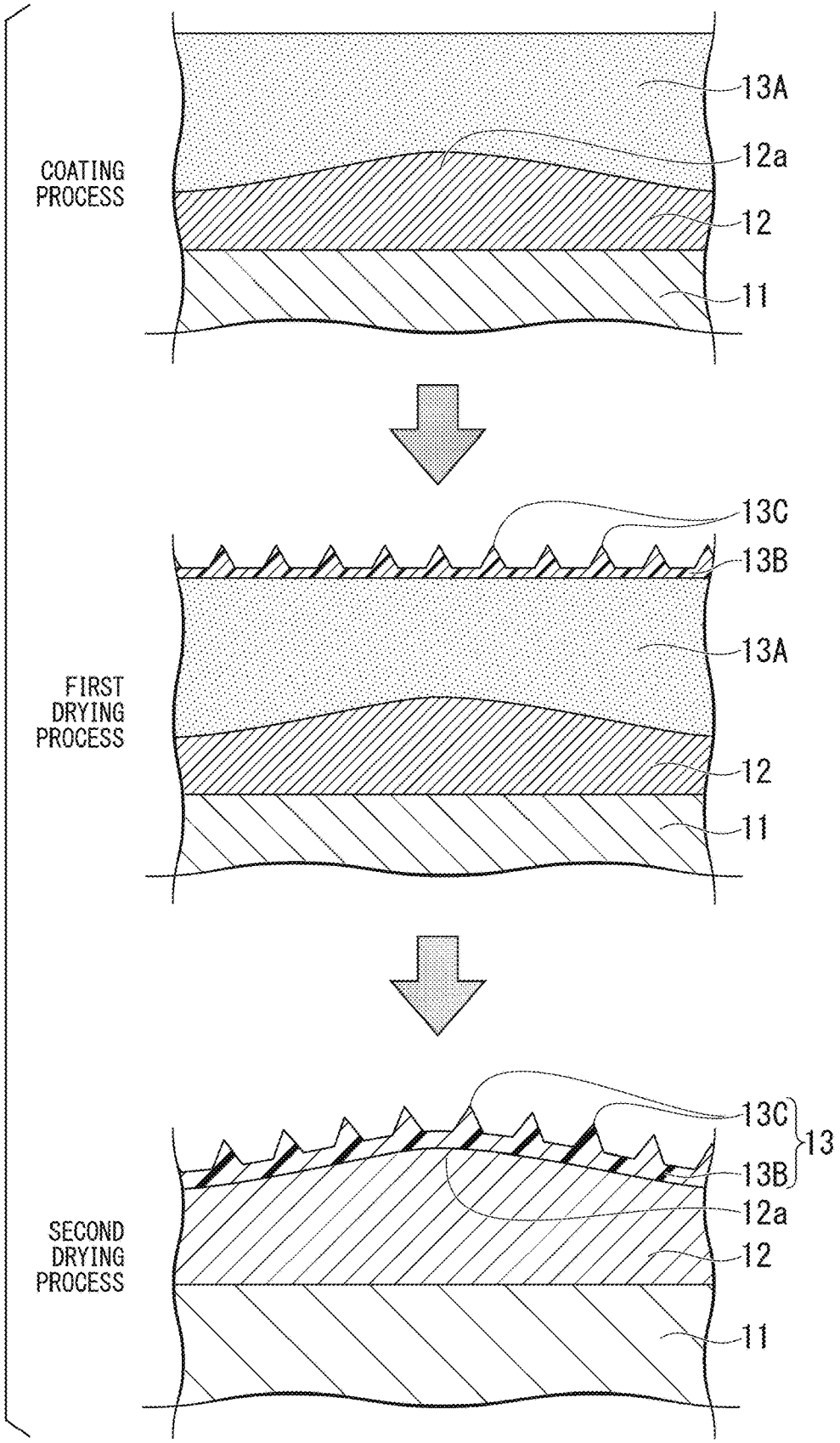
FIG. 2 is a schematic view illustrating a method of producing a surface-treated metal sheet according to the present embodiment.

Next, a preferable method of producing the surface-treated metal sheet 1 according to the present embodiment will be described with reference to FIG. 2. FIG. 2 is a schematic view illustrating a preferable method of producing the surface-treated metal sheet 1 according to the present embodiment. Here, in FIG. 2 used in the following description, in order to facilitate understanding of features of the surface-treated metal sheet 1 according to the present embodiment, feature parts are enlarged for convenience of illustration in some cases, and dimensional proportions and the like of components are not necessarily the same as those of actual components.

The surface metal treatment sheet 1 according to the present embodiment is obtained by a production method including a plating process in which the steel sheet 11 is immersed in a coating bath containing Zn, Al, and Mg to form the coating layer 12 on the surface of the steel sheet 11, a coating process in which a surface-treated metal agent is applied to the coating layer 12, a first drying process in which the surface-treated metal agent is applied and then immediately dried within a predetermined temperature and humidity range, and a second drying process in which the steel sheet 11 to which the surface-treated metal agent is applied is heated (baked) to form a conversion coating containing an organosilicon compound, a phosphate compound and a fluorine compound after the first drying process.

[Plating Process]

The plating process is not particularly limited. A general method may be performed so that sufficient plating adhesion is obtained.

In addition, a method of producing the steel sheet 11 to be subjected to the plating process is not limited.

[Coating Process]

In the coating process, a surface-treated metal agent containing an organosilicon compound, a phosphate compound and a fluorine compound is applied to the surface of the coating layer 12 of the steel sheet 11.

It is preferable to adjust the ratio of the phosphate compound and the fluorine compound with respect to the organosilicon compound according to a desired coating ratio.

The pH of the surface-treated metal agent can be adjusted using a pH adjusting agent such as organic acids such as acetic acid and lactic acid, inorganic acids such as hydrofluoric acid, ammonium salts and amines. In addition, the viscosity of the surface-treated metal agent is preferably in a range of 0.5 mPa·s to 2.0 mPa·s in consideration of operability such as adhesion amount control and controllability of formation of the outermost layer of the coating film of the present embodiment.

The coating method is not limited.

For example, coating can be performed using a roll coater, a bar coater, spray or the like. When a roll coater is used for coating, the film thickness can be easily controlled by adjusting the peripheral speed ratio, and excellent productivity can be obtained.

[First Drying Process]

In the present embodiment, the first drying process in which the sample is held for 0.2 to 10 seconds under an environment of an atmosphere temperature of 10 to 35° C. and a humidity of 30 to 90% is performed until heat drying (second drying process) starts from when the surface-treated metal agent is applied onto the coating layer 12 to form a coating film 13A. According to the first drying process, in the microscopic area on the surface of the finally obtained conversion coating 13, the surface roughness can be precisely controlled to be within the above predetermined range. In the present embodiment, until heat drying is performed after the surface-treated metal agent is applied onto the coating layer 12, under the above environment, the sample is held for 0.2 seconds or longer, and more preferably, 0.5 seconds or longer. Thereby, as shown in FIG. 2, water in the outermost layer of the coating film 13A is evaporated, and as a result, it is conceivable that a fine unevenness 13C, that is, a thin film 13B having a predetermined surface roughness defined in the present embodiment, is formed on the outermost surface of the coating film 13A. A preferable range of the atmosphere temperature is 25 to 35° C., and a preferable range of the humidity is 50 to 80%.

If the humidity in the first drying process is less than 30%, drying proceeds too much, and if the humidity exceeds 90%, drying does not proceed sufficiently, and the conversion coating 13 according to the present embodiment cannot be formed. In addition, if the holding time is shorter than 0.2 seconds, drying does not proceed sufficiently, and the conversion coating 13 according to the present embodiment cannot be formed. Here, even if the time from when the coating film 13A is formed until the heat drying (second drying process) to be described below starts exceeds 10 seconds, the effect is not improved, the productivity decreases, and thus the holding time is set to 10 seconds or shorter. The time for holding the state of the coating film 13A is preferably 10 seconds or shorter and more preferably 5 seconds or shorter. In addition, if the atmosphere temperature in the first drying process is lower than 10° C., drying does not proceed sufficiently, and if the atmosphere temperature exceeds 35° C., drying proceeds too much, and the conversion coating 13 according to the present embodiment cannot be formed.

Here, the start time of the holding time in the first drying process is immediately after the surface-treated metal agent is applied, and the end time of the holding time is the time when heating in the second drying process starts.

[Second Drying Process]

Next, the coating film 13A held in the first drying process for a predetermined time is heated and dried to evaporate water, and the conversion coating 13 is formed. The temperature at which the coating film 13A is dried is selected so that the volatile component in the surface-treated metal agent volatilizes. Specifically, it is preferable that the plate maximum temperature (PMT) when the coating film 13A is dried be within a range of 60 to 150° C. Examples of drying methods for drying the coating film 13A include hot-air drying and furnace drying. According to such a second drying process, the form (fine unevenness 13C) of the outermost layer of the coating film obtained in the first drying process is not influenced by the unevenness 12A on the coating layer 12, and the conversion coating 13 can be formed while the form is maintained.

As described above, the surface-treated metal sheet of the present embodiment can be produced.

EXAMPLES

Steel sheets were immersed in a coating bath to obtain metal sheets M-1 to M-7 having coating layers shown in Table 1. In the description of Table 1, for example, "Zn-19% A1-6% Mg-1.5% Sn-0.5% Ca-0.2% Si" means that it contains, in mass %, 19% of Al, 6% of Mg, 1.5% of Sn, 0.5% of Ca, and 0.2% of Si, with the remainder being Zn and impurities. The basis weight of the coating layer was 90 $g/m^2$.

As the steel sheet, a cold-rolled steel sheet described in JIS G 3141:2017 was used.

For coating, after the surface of the steel sheet was degreased, a surface-treated metal agent containing an organosilicon compound, a fluorine compound, a phosphate compound, and a vanadium compound (V compound) and whose temperature was adjusted was applied as a coating liquid to steel sheets having coating layers M-1 to M-7 using a roll coater as shown in Table 2A and Table 2B. When the surface-treated metal agent was applied onto the coating layer, in some examples, a Co treatment was performed on the coating layer. The Co treatment here was a treatment for reducing black discoloration and specifically, a treatment of spraying an aqueous Co nitrate solution to the surface of the coating layer was performed.

For degreasing, using a degreasing agent (alkaline degreasing agent, product name: Fine Cleaner E6406 commercially available from Nihon Parkerizing Co., Ltd.), a steel sheet having the coating layer on both surfaces was degreased (20 g/L bath, 60° C., spray for 10 seconds, a spray pressure of 50 kPa). Then, washing with water was performed using spray for 10 seconds.

The viscosity of the surface-treated metal agent at 25° C. in the examples was in a viscosity range of 0.5 mPa·s to 2.0 mPa·s.

In addition, in the tables, in the "silane coupling agent" of the organosilicon compound, A1, A2, and B1 are shown below.

A1: 3-aminopropyltrimethoxysilane

A2: 3-aminopropyltriethoxysilane

B1: 3-glycidoxypropyltrimethoxysilane

In addition, in the V compound, Z1 and Z2 are shown below.

Z1: vanadium oxysulfate $VOSO_4$

Z2: vanadium oxyacetylacetonate $VO(OC(=CH_2)CH_2COCH_3)_2$

The surface-treated metal agent was applied, and natural drying was performed at the holding temperature and holding humidity shown in Table 2E and Table 2F, and for the coating film holding time shown in Table 2E and Table 2F (first drying process). Then, the steel sheet was heated to the plate maximum temperature in Table 2C, dried and baked (second drying process). The start time of the coating film holding time in the first drying process was immediately after the surface-treated metal agent was applied, and the end time of the holding time was the time when heating in the second drying process started.

For the obtained conversion coating, the surface roughness of the conversion coating, the number density of organosilicon compounds, the dynamic friction coefficient, the corrosion resistance and the paint adhesion were evaluated. The evaluation method is as follows.

<Sa, Sz and Sq in Rectangular Area with Side of 5 μm>

On the surface of the conversion coating, 20 areas were arbitrarily set as 5 μm square measurement areas. In the measurement areas, Sa, Sz and Sq were measured. A scanning probe microscope (AFM5500M commercially available from Hitachi High-Tech Science Corporation) was used as a measurement device, and the measurement mode was a dynamic focus microscope mode. SI-DF20 was used as the probe, and the tip radius was 10 nm. The average values of the measurement results for 20 measurement areas were defined as Sa, Sz and Sq in a rectangular area with a side of 5 μm on the surface of the conversion coating.

<Sa, Sz and Sq in Rectangular Area with Side of 1 μm>

On the surface of the conversion coating, 40 areas were set as 1 μm square measurement areas. Among the 40 measurement areas, 20 measurement areas were set within the above 20 5 μm rectangular measurement areas, and the remaining 20 measurement areas were arbitrarily set from positions different from the 5 μm rectangular areas. In the measurement areas, Sa, Sz and Sq were measured. The measurement device, measurement mode, probe and tip radius were as described above. Then, the average values of the measurement results for 40 measurement areas were defined as Sa, Sz and Sq in a rectangular area with a side of 1 μm on the surface of the conversion coating.

<Number Density of Organosilicon Compound>

The measurement area set in the method of measuring Sa, Sz and Sq in a rectangular area with a side of 1 μm was used to measure the number density of organosilicon compounds. In the plurality of these measurement areas, images were measured in the measurement mode under a dynamic focus microscope. The organosilicon compounds in the image were determined, and the number of determined organosilicon compounds, and the size thereof were measured. In the plurality of measurement areas, that is, the above 40 measurement areas, the number of organosilicon compound particles and the major axis were measured, and the average values of the measurement results were used as the number of organosilicon compound particles in a rectangular area with a side of 1 μm on the surface of the conversion coating and the major axis thereof. The average values were obtained from the measurement results in the plurality of measurement areas were used as the major axis and the number density.

As a device for determining the organosilicon compound in the image under a dynamic focus microscope, an electron beam microanalyzer (EPMA) and a Fourier transform type microscopic infrared spectrophotometer (microscopic FT-IR) were used. Microscopic FT-IR measurement was performed in a reflection measurement mode. Si was detected by the EPMA, the periphery of the detected Si was measured by the microscopic FT-IR, and when an infrared spectrum corresponding to an organic portion of the organosilicon compound was obtained, the area from which the infrared absorption spectrum was obtained was determined as the organosilicon compound.

<Dynamic Friction Coefficient>

Using a friction measuring machine (commercially available from Shinto Scientific Co., Ltd.), the dynamic friction coefficient on the surface of the conversion coating was measured using a SUS ball with a tip of 10 mmφ as a friction contact and at a moving speed of 150 mm/min and a load of 1.0 N. In addition, the dynamic friction coefficient was measured even when a rust preventive oil was applied. Evaluation results are shown below. Here, those having a dynamic friction coefficient of 0.2 or more and 0.5 or less when no oil was applied (Evaluation 3) and those having a dynamic friction coefficient of less than 0.15 when an oil was applied (Evaluation 1) were evaluated as having a level of the dynamic friction coefficient equivalent to that of the conventional chromate coating, and excellent lubricity after an oil was applied.

3: the dynamic friction coefficient was 0.2 or more and 0.5 or less

2: the dynamic friction coefficient was 0.15 or more and less than 0.2

1: the dynamic friction coefficient was less than 0.15

<Corrosion Resistance>

A salt spray test was performed on a flat test piece for a predetermined time according to JIS Z 2371. Evaluation criteria for corrosion resistance are shown below. 3 or more was satisfactory.

(After 72 Hours of Salt Spray Test)

4: white rust of 5% or less

3: white rust of more than 5% and 15% or less

2: white rust of more than 15% and 30% or less

1: white rust of more than 30%

<Paint Adhesion>

A coating was performed on the test sheet under the following conditions, and a paint adhesion test was performed. Here, two types of paint adhesion were evaluated: primary adhesion in which the test sheet (surface-treated metal sheet) was evaluated without change, and secondary adhesion in which evaluation was performed assuming an environment in which the surface-treated metal sheet was used. If any adhesion was unsatisfactory, it was determined that paint adhesion was insufficient.

(Coating Conditions)

coating condition paint: AMILAC #1000 (registered trademark) (white paint) commercially available from Kansai Paint Co., Ltd.

coating method: bar coating method baking dry conditions: 140° C., for 20 minutes coating film thickness: 25 μm The evaluation method was as follows.

(Primary Adhesion)

A test sheet was cut into one hundred 1 mm square grids with an NT cutter, and a peel test was performed using an adhesive tape, and the number of peeled pieces of the coating film was evaluated. The evaluation criteria are shown below (3 or more was practical performance and satisfactory).

In addition, the "number of peeled pieces" here means the number of pieces from which half or more of respective grids are peeled off (the same applies to the "number of peeled pieces" described below).

4: the number of peeled pieces was 1 or less

3: the number of peeled pieces was more than 1 and 20 or less

2: the number of peeled pieces was more than 20 and 50 or less

1: the number of peeled pieces was more than 50

(Secondary Adhesion)

A test sheet was immersed in boiling water for 2 hours, left overnight, and then cut into one hundred 1 mm square grids with an NT cutter, and a peel test was performed using an adhesive tape, and the number of peeled pieces of the coating film was evaluated. The evaluation criteria are shown below (3 or more was practical performance and satisfactory).

4: the number of peeled pieces was 1 or less

3: the number of peeled pieces was more than 1 and 20 or less

2: the number of peeled pieces was more than 20 and 50 or less

1: the number of peeled pieces was more than 50

Here, the mixing ratio (A/B) of the silane coupling agent (A) and the silane coupling agent (B) in Table 2A and Table 2B was the solid content mass ratio. In addition, the phosphate compound ratio (Y/W) was the ratio of the solid content mass of P derived from a phosphate compound and the solid content mass of Si derived from an organosilicon compound. The fluorine compound ratio (X/W) was the ratio of the solid content mass of F derived from a fluorine compound and the solid content mass of Si derived from an organosilicon compound. The V compound ratio (Z/W) was the ratio of the solid content mass of V derived from a vanadium compound and the solid content mass of Si derived from an organosilicon compound.

As shown in Table 1 to Table 2F, in Invention Examples 1 to 37, the dynamic friction coefficient was 0.2 or more and 0.5 or less when no oil was applied, and the dynamic friction coefficient was less than 0.15 when an oil was applied. This was a level equivalent to that of the dynamic friction coefficient of the conventional chromate coating, no load collapse occurred when a plurality of plated steel sheets were stacked flat, and even if roll forming was performed on the plated steel sheet, it was possible to use the same setting conditions as in the case of the chromate coating, and it was not necessary to readjust processing setting conditions.

In addition, Invention Examples 1 to 42 had excellent corrosion resistance and paint adhesion.

On the other hand, in Comparative Examples 1 to 6, the dynamic friction coefficient was less than 0.2 when no oil was applied, and was less than 0.2 when an oil was applied. This was different from the dynamic friction coefficient of the conventional chromate coating, particularly, the dynamic friction coefficient when no oil was applied was low, and load collapse occurred when a plurality of plated steel sheets were stacked flat. In addition, paint adhesion was not sufficient.

In addition, in Comparative Example 7, since the atmosphere temperature in the first drying process was too low, drying did not proceed sufficiently, and a desired conversion coating could not be formed. In addition, in Comparative Example 8, since the atmosphere temperature in the first drying process was too high, drying proceeded too much, and a desired conversion coating could not be formed.

TABLE 1

| Metal sheet No. | Coating layer composition (mass %) |
|---|---|
| M-1 | Zn-0.2% Al |
| M-2 | Zn-6% Al-3% Mg |
| M-3 | Zn-11% Al-3% Mg-0.2% Si |
| M-4 | Zn-16% Al-6% Mg-0.2% Si |
| M-5 | Zn-19% Al-6% Mg-1.5% Sn-0.5% Ca-0.2% Si |
| M-6 | Zn-24% Al-12% Mg-0.5% Ca-1.2% Si |
| M-7 | Zn-11% Al-3% Mg-0.2% Si-0.05% Ni |

TABLE 2A

| Invention Example or Comparative Example | Plating | Conversion Coating: Organosilicon compound (W): Silane coupling agent A | B | Ratio A/B | Molecular weight | Fluorine compound (X): Type | Ratio X/W | Phosphate compound (Y): Type | Ratio Y/W | V compound (Z): Type | Ratio Z/W | Adhesion amount (one surface) ($g/m^2$) |
|---|---|---|---|---|---|---|---|---|---|---|---|---|
| Invention Example 1 | M-1 | A1 | B1 | 0.5 | 3000 | $ZrF_6^{2-}$ | 0.10 | Phosphate | 0.20 | Z1 | 0.075 | 0.3 |
| Invention Example 2 | M-1 | A1 | B1 | 1.0 | 3000 | $ZrF_6^{2-}$ | 0.10 | Phosphate | 0.20 | Z1 | 0.075 | 0.3 |
| Invention Example 3 | M-1 | A1 | B1 | 2.0 | 3000 | $ZrF_6^{2-}$ | 0.10 | Phosphate | 0.20 | Z1 | 0.075 | 0.3 |
| Invention Example 4 | M-1 | A2 | B1 | 0.5 | 3000 | $ZrF_6^{2-}$ | 0.10 | Phosphate | 0.20 | Z1 | 0.075 | 0.3 |
| Invention Example 5 | M-1 | A2 | B1 | 1.0 | 3000 | $ZrF_6^{2-}$ | 0.10 | Phosphate | 0.20 | Z1 | 0.075 | 0.3 |
| Invention Example 6 | M-1 | A2 | B1 | 2.0 | 3000 | $ZrF_6^{2-}$ | 0.10 | Phosphate | 0.20 | Z1 | 0.075 | 0.3 |
| Invention Example 7 | M-1 | A2 | B1 | 1.0 | 1500 | $ZrF_6^{2-}$ | 0.10 | Phosphate | 0.20 | Z1 | 0.075 | 0.3 |
| Invention Example 8 | M-1 | A2 | B1 | 1.0 | 6000 | $ZrF_6^{2-}$ | 0.10 | Phosphate | 0.20 | Z1 | 0.075 | 0.3 |
| Invention Example 9 | M-1 | A2 | B1 | 1.0 | 9000 | $ZrF_6^{2-}$ | 0.10 | Phosphate | 0.20 | Z1 | 0.075 | 0.3 |
| Invention Example 10 | M-1 | A2 | B1 | 1.0 | 3000 | $ZrF_6^{2-}$ | 0.05 | Phosphate | 0.20 | Z1 | 0.075 | 0.3 |
| Invention Example 11 | M-1 | A2 | B1 | 1.0 | 3000 | $ZrF_6^{2-}$ | 0.10 | Phosphate | 0.10 | Z1 | 0.075 | 0.3 |
| Invention Example 12 | M-1 | A2 | B1 | 1.0 | 3000 | $ZrF_6^{2-}$ | 0.10 | Phosphate | 0.30 | Z1 | 0.075 | 0.3 |
| Invention Example 13 | M-1 | A2 | B1 | 1.0 | 3000 | $ZrF_6^{2-}$ | 0.15 | Phosphate | 0.20 | Z1 | 0.075 | 0.3 |
| Invention Example 14 | M-1 | A2 | B1 | 1.0 | 3000 | $ZrF_6^{2-}$ | 0.10 | Phosphate | 0.20 | Z2 | 0.075 | 0.3 |
| Invention Example 15 | M-1 | A2 | B1 | 1.0 | 3000 | $ZrF_6^{2-}$ | 0.10 | Phosphate | 0.20 | Z1 | 0.025 | 0.3 |
| Invention Example 16 | M-1 | A2 | B1 | 1.0 | 3000 | $ZrF_6^{2-}$ | 0.10 | Phosphate | 0.20 | Z1 | 0.050 | 0.3 |
| Invention Example 17 | M-1 | A2 | B1 | 1.0 | 3000 | $ZrF_6^{2-}$ | 0.10 | Phosphate | 0.20 | Z1 | 0.100 | 0.3 |
| Invention Example 18 | M-1 | A2 | B1 | 1.0 | 3000 | $ZrF_6^{2-}$ | 0.10 | Phosphate | 0.20 | Z1 | 0.200 | 0.3 |
| Invention Example 19 | M-1 | A2 | B1 | 1.0 | 3000 | $ZrF_6^{2-}$ | 0.10 | Phosphate | 0.20 | Z1 | 0.075 | 0.5 |
| Invention Example 20 | M-1 | A2 | B1 | 1.0 | 3000 | $ZrF_6^{2-}$ | 0.10 | Phosphate | 0.20 | Z1 | 0.075 | 0.7 |
| Invention Example 21 | M-1 | A2 | B1 | 1.0 | 3000 | $ZrF_6^{2-}$ | 0.10 | Phosphate | 0.20 | Z1 | 0.075 | 1.0 |
| Invention Example 22 | M-1 | A2 | B1 | 1.0 | 3000 | $ZrF_6^{2-}$ | 0.10 | Phosphate | 0.20 | Z1 | 0.075 | 2.0 |
| Invention Example 23 | M-1 | A2 | B1 | 1.0 | 3000 | $ZrF_6^{2-}$ | 0.10 | Phosphate | 0.20 | Z1 | 0.075 | 0.3 |
| Invention Example 24 | M-1 | A2 | B1 | 1.0 | 3000 | $ZrF_6^{2-}$ | 0.10 | Phosphate | 0.20 | Z1 | 0.075 | 0.3 |
| Invention Example 25 | M-1 | A2 | B1 | 1.0 | 3000 | $ZrF_6^{2-}$ | 0.10 | Phosphate | 0.20 | Z1 | 0.075 | 0.3 |

The underline part indicates outside the scope of the present invention or outside the scope of preferable production conditions.

TABLE 2B

| Invention Example or Comparative Example | Plating | Conversion Coating: Organosilicon compound (W): Silane coupling agent A | B | Ratio A/B | Molecular weight | Fluorine compound (X): Type | Ratio X/W | Phosphate compound (Y): Type Phosphate | Ratio Y/W | V compound (Z): Type | Ratio Z/W | Adhesion amount (one surface) ($g/m^2$) |
|---|---|---|---|---|---|---|---|---|---|---|---|---|
| Invention Example 26 | M-1 | A2 | B1 | 1.0 | 3000 | $ZrF_6^{2-}$ | 0.10 | Phosphate | 0.20 | Z1 | 0.075 | 0.3 |
| Invention Example 27 | M-1 | A2 | B1 | 1.0 | 3000 | $ZrF_6^{2-}$ | 0.10 | Phosphate | 0.20 | Z1 | 0.075 | 0.3 |
| Invention Example 28 | M-1 | A2 | B1 | 1.0 | 3000 | $ZrF_6^{2-}$ | 0.10 | Phosphate | 0.20 | Z1 | 0.075 | 0.3 |
| Invention Example 29 | M-1 | A2 | B1 | 1.0 | 3000 | $ZrF_6^{2-}$ | 0.10 | Phosphate | 0.20 | Z1 | 0.075 | 0.3 |
| Invention Example 30 | M-1 | A2 | B1 | 1.0 | 3000 | $ZrF_6^{2-}$ | 0.10 | Phosphate | 0.20 | Z1 | 0.075 | 0.3 |
| Invention Example 31 | M-2 | A2 | B1 | 1.0 | 3000 | $ZrF_6^{2-}$ | 0.10 | Phosphate | 0.20 | Z1 | 0.075 | 0.3 |
| Invention Example 32 | M-2 | A2 | B1 | 1.0 | 3000 | $ZrF_6^{2-}$ | 0.10 | Phosphate | 0.20 | Z1 | 0.075 | 0.3 |
| Invention Example 33 | M-3 | A2 | B1 | 1.0 | 3000 | $ZrF_6^{2-}$ | 0.10 | Phosphate | 0.20 | Z1 | 0.075 | 0.3 |
| Invention Example 34 | M-4 | A2 | B1 | 1.0 | 3000 | $ZrF_6^{2-}$ | 0.10 | Phosphate | 0.20 | Z1 | 0.075 | 0.3 |
| Invention Example 35 | M-5 | A2 | B1 | 1.0 | 3000 | $ZrF_6^{2-}$ | 0.10 | Phosphate | 0.20 | Z1 | 0.075 | 0.3 |
| Invention Example 36 | M-6 | A2 | B1 | 1.0 | 3000 | $ZrF_6^{2-}$ | 0.10 | Phosphate | 0.20 | Z1 | 0.075 | 0.3 |
| Invention Example 37 | M-7 | A2 | B1 | 1.0 | 3000 | $ZrF_6^{2-}$ | 0.10 | Phosphate | 0.20 | Z1 | 0.075 | 0.3 |
| Comparative Example 1 | M-1 | A2 | B1 | 1.0 | 3000 | $ZrF_6^{2-}$ | 0.10 | Phosphate | 0.20 | Z1 | 0.075 | 0.3 |
| Comparative Example 2 | M-1 | A2 | B1 | 1.0 | 3000 | $ZrF_6^{2-}$ | 0.10 | Phosphate | 0.20 | Z1 | 0.075 | 0.3 |
| Comparative Example 3 | M-1 | A2 | B1 | 1.0 | 3000 | $ZrF_6^{2-}$ | 0.10 | Phosphate | 0.20 | Z1 | 0.075 | 0.3 |
| Comparative Example 4 | M-1 | A2 | B1 | 1.0 | 3000 | $ZrF_6^{2-}$ | 0.10 | Phosphate | 0.20 | Z1 | 0.075 | 0.3 |
| Comparative Example 5 | M-1 | A2 | B1 | 1.0 | 3000 | $ZrF_6^{2-}$ | 0.10 | Phosphate | 0.20 | Z1 | 0.075 | 0.3 |
| Comparative Example 6 | M-1 | A2 | B1 | 1.0 | 3000 | $ZrF_6^{2-}$ | 0.10 | Phosphate | 0.20 | Z1 | 0.075 | 0.3 |
| Comparative Example 7 | M-1 | A2 | B1 | 1.0 | 3000 | $ZrF_6^{2-}$ | 0.10 | Phosphate | 0.20 | Z1 | 0.075 | 0.3 |
| Invention Example 38 | M-1 | A2 | B1 | 1.0 | 3000 | $ZrF_6^{2-}$ | 0.10 | Phosphate | 0.20 | Z1 | 0.075 | 0.3 |
| Invention Example 39 | M-1 | A2 | B1 | 1.0 | 3000 | $ZrF_6^{2-}$ | 0.10 | Phosphate | 0.20 | Z1 | 0.075 | 0.3 |
| Invention Example 40 | M-1 | A2 | B1 | 1.0 | 3000 | $ZrF_6^{2-}$ | 0.10 | Phosphate | 0.20 | Z1 | 0.075 | 0.3 |
| Invention Example 41 | M-1 | A2 | B1 | 1.0 | 3000 | $ZrF_6^{2-}$ | 0.10 | Phosphate | 0.20 | Z1 | 0.075 | 0.3 |
| Invention Example 42 | M-1 | A2 | B1 | 1.0 | 3000 | $ZrF_6^{2-}$ | 0.10 | Phosphate | 0.20 | Z1 | 0.075 | 0.3 |
| Comparative Example 8 | M-1 | A2 | B1 | 1.0 | 3000 | $ZrF_6^{2-}$ | 0.10 | Phosphate | 0.20 | Z1 | 0.075 | 0.3 |

The underline part indicates outside the scope of the present invention or outside the scope of preferable production conditions.

TABLE 2C

| Invention Example or Comparative Example | Surface roughness of conversion coating: Area with a side of 5 μm Sa nm | Sz nm | Sq nm | Area with a side of 1 μm Sa nm | Sz nm | Sq nm | Organosilicon compound number |
|---|---|---|---|---|---|---|---|
| Invention Example 1 | 2.9 | 216 | 58.9 | 6.4 | 610 | 69.7 | 91 |
| Invention Example 2 | 6.3 | 376 | 24.6 | 5.3 | 54 | 41.2 | 8 |
| Invention Example 3 | 6.5 | 783 | 68.0 | 4.2 | 744 | 43.4 | 37 |
| Invention Example 4 | 0.1 | 759 | 48.0 | 7.7 | 457 | 83.4 | 96 |
| Invention Example 5 | 5.5 | 498 | 4.2 | 0.2 | 130 | 72.6 | 24 |
| Invention Example 6 | 7.8 | 258 | 53.1 | 7.2 | 280 | 5.8 | 28 |
| Invention Example 7 | 4.0 | 397 | 65.8 | 7.4 | 715 | 52.8 | 32 |
| Invention Example 8 | 2.1 | 559 | 32.3 | 6.5 | 315 | 20.9 | 41 |
| Invention Example 9 | 9.7 | 572 | 35.0 | 1.9 | 47 | 82.6 | 55 |
| Invention Example 10 | 4.7 | 104 | 68.2 | 3.0 | 785 | 75.0 | 50 |
| Invention Example 11 | 2.3 | 680 | 73.3 | 5.5 | 788 | 81.4 | 22 |
| Invention Example 12 | 0.9 | 393 | 17.6 | 5.1 | 481 | 65.9 | 15 |
| Invention Example 13 | 7.1 | 509 | 6.0 | 2.8 | 644 | 16.4 | 70 |
| Invention Example 14 | 2.6 | 30 | 18.5 | 5.7 | 448 | 23.7 | 35 |
| Invention Example 15 | 3.0 | 537 | 59.9 | 1.2 | 883 | 59.9 | 77 |
| Invention Example 16 | 0.6 | 816 | 81.8 | 1.8 | 389 | 74.7 | 40 |
| Invention Example 17 | 0.8 | 109 | 70.8 | 4.4 | 278 | 47.8 | 45 |
| Invention Example 18 | 2.5 | 286 | 67.6 | 7.8 | 696 | 86.8 | 36 |
| Invention Example 19 | 2.8 | 98 | 18.6 | 2.0 | 766 | 43.1 | 65 |
| Invention Example 20 | 4.3 | 480 | 89.3 | 3.9 | 99 | 44.6 | 87 |
| Invention Example 21 | 1.0 | 419 | 71.3 | 0.7 | 629 | 70.4 | 48 |
| Invention Example 22 | 8.3 | 142 | 7.5 | 4.0 | 521 | 63.2 | 25 |
| Invention Example 23 | 1.9 | 400 | 66.7 | 2.3 | 394 | 78.3 | 51 |
| Invention Example 24 | 3.1 | 553 | 59.4 | 2.2 | 40 | 48.8 | 88 |
| Invention Example 25 | 6.0 | 689 | 78.7 | 4.6 | 425 | 63.9 | 97 |

The underline part indicates outside the scope of the present invention or outside the scope of preferable production conditions.

TABLE 2D

| Invention Example or Comparative Example | surface roughness of conversion coating: Area with a side of 5 μm Sa nm | Sz nm | Sq nm | Area with a side of 1 μm Sa nm | Sz nm | Sq nm | Organosilicon compound number |
|---|---|---|---|---|---|---|---|
| Invention Example 26 | 5.3 | 736 | 44.6 | 5.6 | 190 | 76.3 | 72 |

TABLE 2D-continued

| Invention Example or Comparative Example | surface roughness of conversion coating: Area with a side of 5 μm Sa nm | Sz nm | Sq nm | Area with a side of 1 μm Sa nm | Sz nm | Sq nm | Organosilicon compound number |
|---|---|---|---|---|---|---|---|
| Invention Example 27 | 4.6 | 701 | 54.1 | 3.6 | 213 | 30.0 | 33 |
| Invention Example 28 | 9.4 | 998 | 99.6 | 9.8 | 987 | 94.7 | 49 |
| Invention Example 29 | 8.5 | 865 | 41.5 | 0.1 | 982 | 46.1 | 46 |
| Invention Example 30 | 4.4 | 290 | 37.0 | 8.7 | 258 | 59.2 | 19 |
| Invention Example 31 | 5.4 | 272 | 18.3 | 6.2 | 180 | 79.7 | 57 |
| Invention Example 32 | 6.6 | 100 | 59.8 | 5.9 | 551 | 32.2 | 82 |
| Invention Example 33 | 5.0 | 391 | 14.6 | 8.8 | 664 | 47.9 | 74 |
| Invention Example 34 | 4.9 | 464 | 63.2 | 8.5 | 763 | 59.5 | 20 |
| Invention Example 35 | 6.9 | 328 | 62.1 | 2.1 | 871 | 1.5 | 95 |
| Invention Example 36 | 7.2 | 126 | 39.8 | 10.0 | 140 | 56.3 | 2 |
| Invention Example 37 | 5.8 | 593 | 71.3 | 5.6 | 997 | 93.6 | 7 |
| Comparative Example 1 | 15.2 | 1437 | 194 | 14.8 | 1608 | 195 | 195 |
| Comparative Example 2 | 18.0 | 1432 | 171 | 20.0 | 1846 | 101 | 213 |
| Comparative Example 3 | 12.8 | 1078 | 145 | 15.0 | 1574 | 175 | 254 |
| Comparative Example 4 | 13.7 | 1961 | 193 | 17.7 | 1557 | 182 | 289 |
| Comparative Example 5 | 0.04 | 0.5 | 0.07 | 0.07 | 0.9 | 0.01 | 14 |
| Comparative Example 6 | 0.05 | 1.0 | 0.01 | 0.04 | 0.5 | 0.09 | 6 |
| Comparative Example 7 | 0.05 | 0.8 | 0.05 | 0.07 | 0.7 | 0.09 | 254 |
| Invention Example 38 | 0.08 | 0.6 | 0.06 | 0.08 | 0.9 | 0.3 | 55 |
| Invention Example 39 | 0.07 | 0.9 | 0.6 | 0.3 | 0.9 | 3.2 | 62 |
| Invention Example 40 | 3.4 | 0.8 | 0.9 | 0.4 | 92 | 26.0 | 66 |
| Invention Example 41 | 8.2 | 424 | 56.0 | 1.9 | 380 | 91.1 | 18 |
| Invention Example 42 | 8.8 | 473 | 56.0 | 5.0 | 300 | 54.3 | 64 |
| Comparative Example 8 | 15.0 | 1081 | 157 | 12.0 | 1005 | 103 | 219 |

The underline part indicates outside the scope of the present invention or outside the scope of preferable production conditions.

TABLE 2E

| Invention Example or Comparative Example | Evaluation: Dynamic friction coefficient: No oil application | Oil application | Corrosion resistance | Paint adhesion: Primary | Secondary | Production conditions: Coating film holding time (sec) | Holding temperature (° C.) | Holding humidity (%) | Plate maximum temperature (° C.) | Co treatment |
|---|---|---|---|---|---|---|---|---|---|---|
| Invention Example 1 | 3 | 1 | 4 | 4 | 4 | 2 | 25 | 80 | 80 | No |
| Invention Example 2 | 3 | 1 | 4 | 4 | 4 | 2 | 25 | 80 | 80 | No |

TABLE 2E-continued

| Invention Example or Comparative Example | Evaluation: Dynamic friction coefficient: No oil application | Evaluation: Dynamic friction coefficient: Oil application | Evaluation: Corrosion resistance | Evaluation: Paint adhesion: Primary | Evaluation: Paint adhesion: Secondary | Production conditions: Coating film holding time (sec) | Production conditions: Holding temperature (° C.) | Production conditions: Holding humidity (%) | Production conditions: Plate maximum temperature (° C.) | Production conditions: Co treatment |
|---|---|---|---|---|---|---|---|---|---|---|
| Invention Example 3 | 3 | 1 | 4 | 4 | 4 | 2 | 25 | 80 | 80 | No |
| Invention Example 4 | 3 | 1 | 1 | 4 | 4 | 2 | 25 | 80 | 80 | No |
| Invention Example 5 | 3 | 1 | 4 | 4 | 4 | 2 | 25 | 80 | 80 | No |
| Invention Example 6 | 3 | 1 | 4 | 4 | 4 | 2 | 25 | 80 | 80 | No |
| Invention Example 7 | 3 | 1 | 4 | 4 | 4 | 2 | 25 | 80 | 80 | No |
| Invention Example 8 | 3 | 1 | 4 | 4 | 4 | 2 | 25 | 80 | 80 | No |
| Invention Example 9 | 3 | 1 | 4 | 4 | 4 | 2 | 25 | 80 | 80 | No |
| Invention Example 10 | 3 | 1 | 4 | 4 | 4 | 2 | 25 | 80 | 80 | No |
| Invention Example 11 | 3 | 1 | 4 | 4 | 4 | 2 | 25 | 80 | 80 | No |
| Invention Example 12 | 3 | 1 | 4 | 4 | 4 | 2 | 25 | 80 | 80 | No |
| Invention Example 13 | 3 | 1 | 4 | 4 | 4 | 2 | 25 | 80 | 80 | No |
| Invention Example 14 | 3 | 1 | 4 | 4 | 4 | 2 | 25 | 80 | 80 | No |
| Invention Example 15 | 3 | 1 | 4 | 4 | 4 | 2 | 25 | 80 | 80 | No |
| Invention Example 16 | 3 | 1 | 4 | 4 | 4 | 2 | 25 | 80 | 80 | No |
| Invention Example 17 | 3 | 1 | 4 | 4 | 4 | 2 | 25 | 80 | 80 | No |
| Invention Example 18 | 3 | 1 | 4 | 4 | 4 | 2 | 25 | 80 | 80 | No |
| Invention Example 19 | 3 | 1 | 3 | 4 | 4 | 2 | 25 | 80 | 80 | No |
| Invention Example 20 | 3 | 1 | 4 | 4 | 4 | 2 | 25 | 80 | 80 | No |
| Invention Example 21 | 3 | 1 | 4 | 4 | 4 | 2 | 25 | 80 | 80 | No |
| Invention Example 22 | 3 | 1 | 4 | 4 | 3 | 2 | 25 | 80 | 80 | No |
| Invention Example 23 | 3 | 1 | 4 | 4 | 4 | 2 | 25 | 80 | 60 | No |
| Invention Example 24 | 3 | 1 | 4 | 4 | 4 | 2 | 25 | 80 | 120 | No |
| Invention Example 25 | 3 | 1 | 3 | 4 | 4 | 2 | 25 | 80 | 150 | No |

The underline part indicates outside the scope of the present invention or outside the scope of preferable production conditions.

TABLE 2F

| Invention Example or Comparative Example | Evaluation: Dynamic friction coefficient: No oil application | Evaluation: Dynamic friction coefficient: Oil application | Evaluation: Corrosion resistance | Evaluation: Paint adhesion: Primary | Evaluation: Paint adhesion: Secondary | Production conditions: Coating film holding time (sec) | Production conditions: Holding temperature (° C.) | Production conditions: Holding humidity (%) | Production conditions: Plate maximum temperature (° C.) | Production conditions: Co treatment |
|---|---|---|---|---|---|---|---|---|---|---|
| Invention Example 26 | 3 | 1 | 4 | 4 | 4 | 2 | 25 | 80 | 80 | Yes |

TABLE 2F-continued

| Invention Example or Comparative Example | Evaluation: Dynamic friction coefficient: No oil application | Evaluation: Dynamic friction coefficient: Oil application | Evaluation: Corrosion resistance | Evaluation: Paint adhesion: Primary | Evaluation: Paint adhesion: Secondary | Production conditions: Coating film holding time (sec) | Production conditions: Holding temperature (° C.) | Production conditions: Holding humidity (%) | Production conditions: Plate maximum temperature (° C.) | Production conditions: Co treatment |
|---|---|---|---|---|---|---|---|---|---|---|
| Invention Example 27 | 3 | 1 | 4 | 4 | 4 | 10 | 25 | 80 | 80 | No |
| Invention Example 28 | 3 | 1 | 4 | 4 | 4 | 2 | 25 | 30 | 80 | No |
| Invention Example 29 | 3 | 1 | 4 | 4 | 4 | 2 | 25 | 50 | 80 | No |
| Invention Example 30 | 3 | 1 | 4 | 4 | 4 | 2 | 25 | 90 | 80 | No |
| Invention Example 31 | 3 | 1 | 4 | 4 | 4 | 2 | 25 | 80 | 80 | No |
| Invention Example 32 | 3 | 1 | 3 | 4 | 4 | 2 | 25 | 80 | 80 | Yes |
| Invention Example 33 | 3 | 1 | 4 | 4 | 4 | 2 | 25 | 80 | 80 | No |
| Invention Example 34 | 3 | 1 | 4 | 4 | 4 | 2 | 25 | 80 | 80 | No |
| Invention Example 35 | 3 | 1 | 4 | 4 | 4 | 2 | 25 | 80 | 80 | No |
| Invention Example 36 | 3 | 1 | 4 | 1 | 4 | 2 | 25 | 80 | 80 | No |
| Invention Example 37 | 3 | 1 | 4 | 4 | 4 | 2 | 25 | 80 | 80 | No |
| Comparative Example 1 | 2 | 2 | 4 | 2 | 2 | 0.1 | 25 | 10 | 80 | No |
| Comparative Example 2 | 2 | 2 | 4 | 1 | 2 | 2 | 25 | 10 | 80 | No |
| Comparative Example 3 | 2 | 2 | 4 | 2 | 1 | 0.1 | 25 | 20 | 80 | No |
| Comparative Example 4 | 2 | 2 | 4 | 2 | 2 | 2 | 25 | 20 | 80 | No |
| Comparative Example 5 | 2 | 1 | 4 | 1 | 2 | 0.1 | 25 | 100 | 80 | No |
| Comparative Example 6 | 2 | 1 | 4 | 1 | 2 | 2 | 25 | 100 | 80 | No |
| Comparative Example 7 | 3 | 1 | 4 | 2 | 2 | 2 | 5 | 80 | 80 | No |
| Invention Example 38 | 3 | 1 | 4 | 3 | 3 | 2 | 10 | 80 | 80 | No |
| Invention Example 39 | 3 | 1 | 4 | 4 | 3 | 2 | 15 | 80 | 80 | No |
| Invention Example 40 | 3 | 1 | 4 | 4 | 3 | 2 | 20 | 80 | 80 | No |
| Invention Example 41 | 3 | 1 | 4 | 4 | 4 | 2 | 30 | 80 | 80 | No |
| Invention Example 42 | 3 | 1 | 4 | 4 | 1 | 2 | 35 | 80 | 80 | No |
| Comparative Example 8 | 3 | 2 | 4 | 4 | 4 | 2 | 40 | 80 | 80 | No |

The underline part indicates outside the scope of the present invention or outside the scope of preferable production conditions.

INDUSTRIAL APPLICABILITY

According to the present invention, it is possible to obtain a surface-treated metal sheet having a conversion coating that has a level of lubricity equivalent to that of a conventional chromate coating and has excellent corrosion resistance and paint adhesion.

BRIEF DESCRIPTION OF THE REFERENCE SYMBOLS

1 Surface-treated metal sheet
11 Steel sheet
12 Coating layer (Plating layer)
13 Conversion Coating

What is claimed is:

1. A surface-treated metal sheet, comprising:

a steel sheet;

a plating layer containing zinc formed on the steel sheet; and a coating formed on the plating layer, wherein the coating contains an organosilicon compound, a phosphate compound and a fluorine compound, wherein, the surface roughness in a rectangular area with a side of 1 μm on the surface of the coating is represented by a root mean square roughness Sq of 0.10 to 100 nm, and is further optionally represented by one or more of an arithmetic mean height Sa of 0.10 to 10.0 nm and a maximum height Sz of 1.0 to 1,000 nm.

2. The surface-treated metal sheet according to claim 1, wherein, the surface roughness in a rectangular area with a side of 5 μm on the surface of the coating is represented by a root mean square roughness Sq of 0.10 to 100 nm, and is further optionally represented by one or more of an arithmetic mean height Sa of 0.10 to 10.0 nm and a maximum height Sz of 1.0 to 1.000 nm.

3. The surface-treated metal sheet according to claim 2, wherein a rectangular area with a side of 1 μm on the surface of the coating contains 1 or more and 100 or less granular organosilicon compound particles having a major axis of 10 nm or more and 300 nm or less.

4. The surface-treated metal sheet according to claim 3, wherein the plating layer has an average chemical composition containing, in mass %, Al: more than 4.0% and less than 25.0%,
Mg: more than 1.0% and less than 12.5%,
Sn: 0% to 20%,
Bi: 0% and less than 5.0%,
In: 0% and less than 2.0%,
Ca: 0% to 3.0%,
Y: 0% to 0.5%,
La: 0% and less than 0.5%,
Ce: 0% and less than 0.5%,
Si: 0% and less than 2.5%,
Cr: 0% and less than 0.25%,
Ti: 0% and less than 0.25%,
Ni: 0% and less than 0.25%,
Co: 0% and less than 0.25%,
V: 0% and less than 0.25%,
Nb: 0% and less than 0.25%,
Cu: 0% and less than 0.25%,
Mn: 0% and less than 0.25%,
Fe: 0% to 5.0%,
Sr: 0% and less than 0.5%,
Sb: 0% and less than 0.5%,
Pb: 0% and less than 0.5%, and
B: 0% and less than 0.5% with the remainder comprising Zn and impurities.

5. The surface-treated metal sheet according to claim 2, wherein the plating layer has an average chemical composition containing, in mass %, Al: more than 4.0% and less than 25.0%,
Mg: more than 1.0% and less than 12.5%,
Sn: 0% to 20%,
Bi: 0% and less than 5.0%,
In: 0% and less than 2.0%,
Ca: 0% to 3.0%,
Y: 0% to 0.5%,
La: 0% and less than 0.5%,
Ce: 0% and less than 0.5%,
Si: 0% and less than 2.5%,
Cr: 0% and less than 0.25%,
Ti: 0% and less than 0.25%,
Ni: 0% and less than 0.25%,
Co: 0% and less than 0.25%,
V: 0% and less than 0.25%,
Nb: 0% and less than 0.25%,
Cu: 0% and less than 0.25%,
Mn: 0% and less than 0.25%,
Fe: 0% to 5.0%,
Sr: 0% and less than 0.5%,
Sb: 0% and less than 0.5%,
Pb: 0% and less than 0.5%, and
B: 0% and less than 0.5% with the remainder comprising Zn and impurities.

6. The surface-treated metal sheet according to claim 1, wherein a rectangular area with a side of 1 μm on the surface of the coating contains 1 or more and 100 or less granular organosilicon compound particles having a major axis of 10 nm or more and 300 nm or less.

7. The surface-treated metal sheet according to claim 6, wherein the plating layer has an average chemical composition containing, in mass %, Al: more than 4.0% and less than 25.0%,
Mg: more than 1.0% and less than 12.5%,
Sn: 0% to 20%,
Bi: 0% and less than 5.0%,
In: 0% and less than 2.0%,
Ca: 0% to 3.0%,
Y: 0% to 0.5%,
La: 0% and less than 0.5%,
Ce: 0% and less than 0.5%,
Si: 0% and less than 2.5%,
Cr: 0% and less than 0.25%,
Ti: 0% and less than 0.25%,
Ni: 0% and less than 0.25%,
Co: 0% and less than 0.25%,
V: 0% and less than 0.25%,
Nb: 0% and less than 0.25%,
Cu: 0% and less than 0.25%,
Mn: 0% and less than 0.25%,
Fe: 0% to 5.0%,
Sr: 0% and less than 0.5%,
Sb: 0% and less than 0.5%,
Pb: 0% and less than 0.5%, and
B: 0% and less than 0.5% with the remainder comprising Zn and impurities.

8. The surface-treated metal sheet according to claim 1, wherein the plating layer has an average chemical composition containing, in mass %, Al: more than 4.0% and less than 25.0%,
Mg: more than 1.0% and less than 12.5%,
Sn: 0% to 20%,
Bi: 0% and less than 5.0%,
In: 0% and less than 2.0%,
Ca: 0% to 3.0%,
Y: 0% to 0.5%,
La: 0% and less than 0.5%,
Ce: 0% and less than 0.5%,
Si: 0% and less than 2.5%,
Cr: 0% and less than 0.25%,
Ti: 0% and less than 0.25%,
Ni: 0% and less than 0.25%,
Co: 0% and less than 0.25%,
V: 0% and less than 0.25%,
Nb: 0% and less than 0.25%,
Cu: 0% and less than 0.25%,
Mn: 0% and less than 0.25%,
Fe: 0% to 5.0%,
Sr: 0% and less than 0.5%,
Sb: 0% and less than 0.5%,
Pb: 0% and less than 0.5%, and
B: 0% and less than 0.5% with the remainder comprising Zn and impurities.

* * * * *